US011578454B2

(12) United States Patent
Choi et al.

(10) Patent No.: US 11,578,454 B2
(45) Date of Patent: Feb. 14, 2023

(54) METHOD OF CONTROLLING LAUNDRY TREATING APPARATUS

(71) Applicant: LG ELECTRONICS INC., Seoul (KR)

(72) Inventors: Hongki Choi, Seoul (KR); Mikyung Kim, Seoul (KR); Deokjoon Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 17/704,529

(22) Filed: Mar. 25, 2022

(65) Prior Publication Data

US 2022/0213642 A1 Jul. 7, 2022

Related U.S. Application Data

(63) Continuation of application No. 15/608,467, filed on May 30, 2017, now Pat. No. 11,319,663.

(30) Foreign Application Priority Data

May 31, 2016 (KR) ..... 10-2016-0067278

(51) Int. Cl.
*D06F 58/44* (2020.01)
*D06F 73/02* (2006.01)
(Continued)

(52) U.S. Cl.
CPC ..... *D06F 58/44* (2020.02); *D06F 73/02* (2013.01); *D06F 58/12* (2013.01); *D06F 58/203* (2013.01);
(Continued)

(58) Field of Classification Search
CPC ..... D06F 58/44; D06F 73/02; D06F 58/12; D06F 58/203; D06F 58/206; D06F 58/38;
(Continued)

(56) References Cited

U.S. PATENT DOCUMENTS 4,761,896 A 8/1988 Miyata ..... D06F 43/088 34/611
2009/0126423 A1 5/2009 Bae ..... D06F 58/203 68/5 C (Continued)

FOREIGN PATENT DOCUMENTS

CN 1037557 A 11/1989
CN 101415879 A 4/2009

(Continued)

*Primary Examiner* — Jessica Yuen
(74) *Attorney, Agent, or Firm* — Dentons US LLP

(57) ABSTRACT

Disclosed herein is a method of controlling a laundry treating apparatus, if a user selects a uniform course, including performing a preheating operation of a heater to generate steam, performing a first cooling operation to operate a blower unit and a moving hanger after the preheating operation has been terminated, performing a steam operation to operate the blower unit and a steam unit and to circulate steam to a treating chamber after the first cooling operation has been terminated, performing a standby operation to operate the blower unit after the steam operation has been terminated, performing a second cooling operation to operate the blower unit after the standby operation has been terminated, and performing a drying operation to operate the blower unit and a heat pump unit and to provide heat to the treating chamber to dry the treating chamber after the second cooling operation has been terminated.

20 Claims, 8 Drawing Sheets

(51) Int. Cl.

| | |
|---|---|
| ***D06F 58/12*** | (2006.01) |
| ***D06F 58/20*** | (2006.01) |
| ***D06F 103/36*** | (2020.01) |
| ***D06F 105/24*** | (2020.01) |
| ***D06F 103/32*** | (2020.01) |
| ***D06F 105/00*** | (2020.01) |
| ***D06F 105/26*** | (2020.01) |
| ***D06F 105/30*** | (2020.01) |
| ***D06F 105/40*** | (2020.01) |
| ***D06F 58/38*** | (2020.01) |
| ***D06F 58/42*** | (2020.01) |

(52) U.S. Cl.
CPC ..... *D06F 58/206* (2013.01); *D06F 58/38* (2020.02); *D06F 58/42* (2020.02); *D06F 2103/32* (2020.02); *D06F 2103/36* (2020.02); *D06F 2105/00* (2020.02); *D06F 2105/24* (2020.02); *D06F 2105/26* (2020.02); *D06F 2105/30* (2020.02); *D06F 2105/40* (2020.02)

(58) Field of Classification Search
CPC .. D06F 58/42; D06F 2103/32; D06F 2103/36; D06F 2105/00; D06F 2105/24; D06F 2105/26; D06F 2105/30; D06F 2105/40; D06F 58/34; D06F 2103/12; D06F 33/00; D06F 2103/50; D06F 35/00; D06F 58/20; D06F 58/24
See application file for complete search history.

(56) References Cited

U.S. PATENT DOCUMENTS

| | | | | |
|---|---|---|---|---|
| 2010/0050465 | A1 | 3/2010 | Im | D06F 39/008 34/380 |
| 2012/0246839 | A1 | 10/2012 | Park | D06F 58/10 8/137 |
| 2013/0198971 | A1* | 8/2013 | Doh | D06F 58/36 8/137 |

FOREIGN PATENT DOCUMENTS

| | | | | |
|---|---|---|---|---|
| CN | 101772601 | A | 7/2010 | |
| CN | 102119277 | A | 7/2011 | |
| CN | 102656311 | A | 9/2012 | |
| CN | 102725446 | A | 10/2012 | |
| EP | 1870506 | A1 | 12/2007 | |
| EP | 2182104 | A2 | 5/2010 | D06F 25/00 |
| EP | 2594690 | A1 | 5/2013 | |
| EP | 2623662 | A1 | 8/2013 | |
| EP | 2733257 | A1 | 5/2014 | |
| JP | 2002-028398 | A | 1/2002 | |
| JP | 2009-291233 | A | 12/2009 | |
| KR | 10-2007-0052733 | A | 5/2007 | |
| KR | 10-0808868 | B1 | 3/2008 | |
| KR | 10-2011-0067890 | A | 6/2011 | |
| KR | 10-2011-0067891 | A | 6/2011 | |
| WO | 2009/020311 | A2 | 2/2009 | |
| WO | 2011/074850 | A2 | 6/2011 | |

* cited by examiner

METHOD OF CONTROLLING LAUNDRY TREATING APPARATUS

CROSS-REFERENCE TO RELATED APPLICATION

This is a Continuation of U.S. patent application Ser. No. 15/608,467, filed on May 30, 2017, which claims the benefit of foreign priority to Korean Application No. 10-2016-0067278, filed May 31, 2016, all of which are incorporated by reference in their entirety herein.

BACKGROUND OF THE INVENTION

1. Field of the Invention

The present invention relates to a method of controlling a laundry treating apparatus and, more particularly, to a method of controlling a laundry treating apparatus for clothing which is frequently worn, such as a uniform.

2. Description of the Related Art

In general, laundry treating apparatuses mean all apparatuses which manage or treat clothing at home or in a laundry, for example, apparatuses which wash and dry clothing or remove wrinkles from clothing. For example, laundry treating apparatuses may include a washing machine which washes clothing, a drying machine which dries clothing, a washing and drying machine which has both a washing function and a drying function, a refresher which refreshes clothing, a steamer which removes unnecessary wrinkles from clothing, etc.

In more detail, a refresher is an apparatus which refreshes clothing to a more comfortable and fresh state, and performs a function of providing scent to clothing, a function of preventing generation of static electricity from clothing, or a function of removing winkles from clothing. A steamer is an apparatus which generally supplies steam to clothing to remove wrinkles from the clothing, and delicately removes wrinkles from the clothing because a heat plate does not contact the clothing, differently from a general iron.

A laundry treating apparatus having both functions of a refresher and a steamer may perform a function of removing wrinkles and odors from clothing received therein using steam and hot air. Due to such a function, odor particles contaminating the clothing may be removed from the clothing received in the laundry treating apparatus, and wrinkles may be removed from the clothing and thus an ironing effect may be acquired.

SUMMARY OF THE INVENTION

An object of the present invention is to provide a method of controlling a laundry treating apparatus for clothing which is frequently worn, such as a uniform.

The objects of the present invention are not limited to the above-mentioned objects and other objects that have not been mentioned above will become evident to those skilled in the art from the following description.

To achieve the above objects, there is provided a method of controlling a laundry treating apparatus, having a case provided with a treating chamber and a cycle chamber, a moving hanger disposed in the treating chamber and providing vibration to clothing hung thereon, a blower unit disposed in the cycle chamber and circulating air of the treating chamber, a steam unit disposed in the cycle chamber and supplying steam to the treating chamber, and a heat pump unit disposed in the cycle chamber and generating heat through a refrigeration cycle using a refrigerant, according to an exemplary embodiment of the present invention, the method, if a user selects a first course, including performing a preheating operation of a heater to generate steam by supplying power to the steam unit, performing a first cooling operation to operate the blower unit and the moving hanger after the preheating operation has been terminated, performing a steam operation to operate the blower unit and the steam unit and to circulate steam generated by the steam unit to the treating chamber after the first cooling operation has been terminated, performing a standby operation to operate the blower unit after the steam operation has been terminated, performing a second cooling operation to operate the blower unit after the standby operation has been terminated, and performing a drying operation to operate the blower unit and the heat pump unit and to provide heat generated by the heat pump unit to the treating chamber to dry the treating chamber after the second cooling operation has been terminated.

The moving hanger may be operated in the second cooling operation.

The moving hanger may be operated in the drying operation.

The first cooling operation may be performed for a first cooling time, the second cooling operation may be performed for a second cooling time, and the first cooling time may be set to be longer than the second cooling time.

The blower unit may be operated at a first cooling rpm in the first cooling operation, the blower unit may be operated at a steam rpm in the steam operation, the blower unit may be operated at a standby rpm in the standby operation, and the first cooling rpm may be set to be higher than the steam rpm and the standby rpm.

In the drying operation, a control unit may control operation of the heat pump unit based on a preheating inlet temperature measured by an inlet temperature sensor of the blower unit during performance of the preheating operation, the heat pump unit may include a compressor configured to compress the refrigerant and a condenser configured to exchange heat between the refrigerant compressed by the compressor and air drawn into the blower unit, the control unit may operate the compressor at a predetermined first operating speed if the preheating inlet temperature is lower than a predetermined reference inlet temperature and operate the compressor at a predetermined second operating speed if the preheating inlet temperature is higher than or equal to the predetermined reference inlet temperature, and the second operating speed may be set to be lower than the first operating speed.

The first course may be a uniform course or a school uniform course.

To achieve the above objects, there is provided a method of controlling a laundry treating apparatus, having a case provided with a treating chamber and a cycle chamber, a moving hanger disposed in the treating chamber and providing vibration to clothing hung thereon, a blower unit disposed in the cycle chamber and circulating air of the treating chamber, a steam unit disposed in the cycle chamber and supplying steam to the treating chamber, and a heat pump unit disposed in the cycle chamber and generating heat through a refrigeration cycle using a refrigerant, according to an exemplary embodiment of the present invention, the method, if a user selects a first course, including performing a first cooling operation to operate the blower unit and the moving hanger, performing a preheating operation of a heater to generate steam by supplying power to the steam unit after the first cooling operation has been terminated, performing a steam operation to operate the blower unit and the steam unit and to circulate steam generated by the steam unit to the treating chamber after the preheating operation has been terminated, performing a standby operation to operate the blower unit after the steam operation has been terminated, performing a second cooling operation to operate the blower unit after the standby operation has been terminated, and performing a drying operation to operate the blower unit and the heat pump unit and to provide heat generated by the heat pump unit to the treating chamber to dry the treating chamber after the second cooling operation has been terminated.

To achieve the above objects, there is provided a method of controlling a laundry treating apparatus, having a case provided with a treating chamber and a cycle chamber, a moving hanger disposed in the treating chamber and providing vibration to clothing hung thereon, a blower unit disposed in the cycle chamber and circulating air of the treating chamber, a steam unit disposed in the cycle chamber and supplying steam to the treating chamber, and a heat pump unit disposed in the cycle chamber and generating heat through a refrigeration cycle using a refrigerant, according to an exemplary embodiment of the present invention, the method, if a user selects a first course, including performing a first cooling operation to operate the blower unit and the moving hanger, performing a preheating operation of a heater to generate steam by supplying power to the steam unit during performance of the first cooling operation, performing a steam operation to operate the blower unit and the steam unit and to circulate steam generated by the steam unit to the treating chamber after the preheating operation has been terminated, performing a standby operation to operate the blower unit after the steam operation has been terminated, performing a second cooling operation to operate the blower unit after the standby operation has been terminated, and performing a drying operation to operate the blower unit and the heat pump unit and to provide heat generated by the heat pump unit to the treating chamber to dry the treating chamber after the second cooling operation has been terminated.

When the first cooling operation and the preheating operation are simultaneously operated, the end time of the first cooling operation and the end time of the preheating operation may coincide with each other.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE EMBODIMENTS

The advantages and features of the present invention, and the way of attaining the same, will become apparent with reference to embodiments described below in conjunction with the accompanying drawings. Reference will now be made in detail to the preferred embodiments of the present invention, examples of which are illustrated in the accompanying drawings. Wherever possible, the same reference numbers will be used throughout the drawings to refer to the same or like parts.

Hereinafter, a laundry treating apparatus and a method of controlling the same in accordance with embodiments of the present invention will be described with reference to the accompanying drawings.

Figure 1:
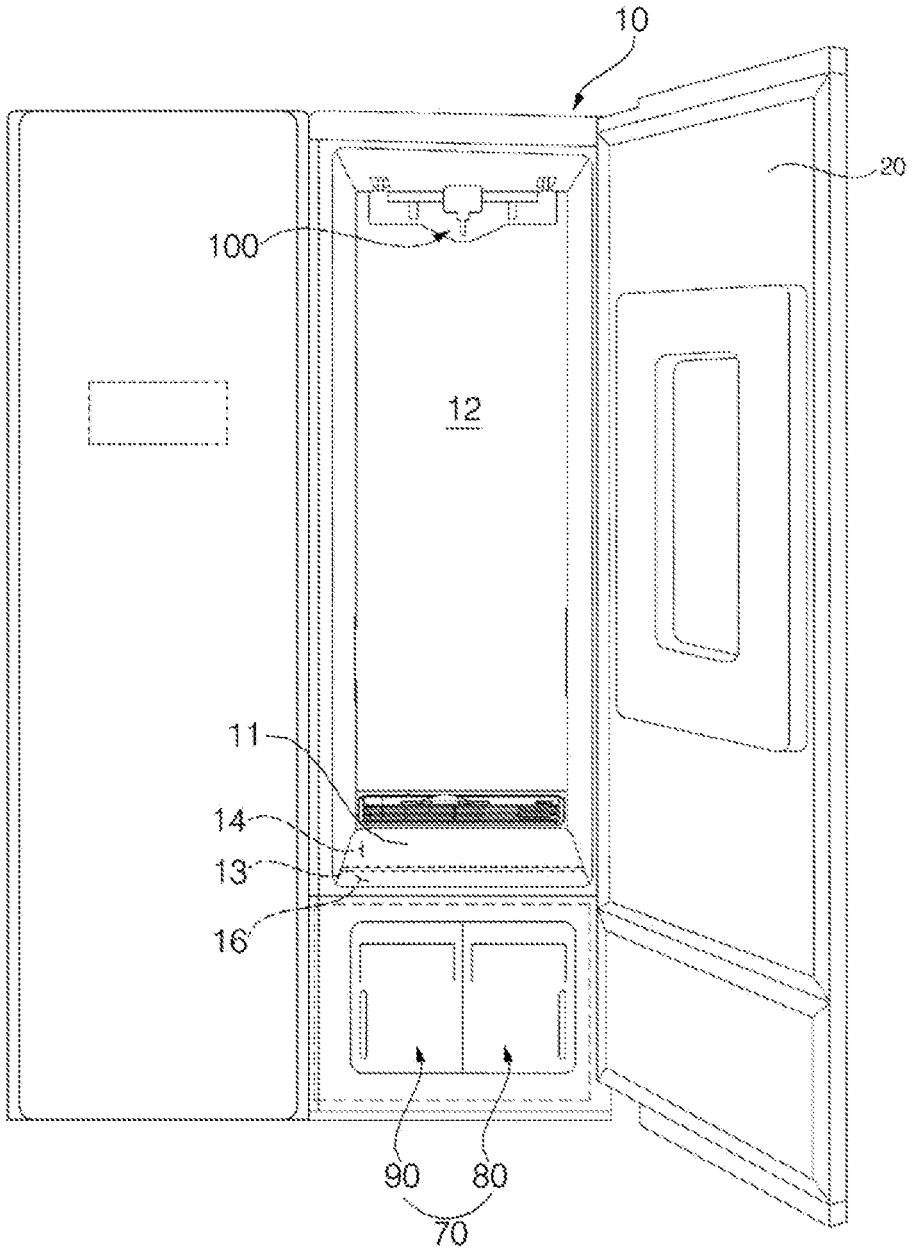
FIG. 1 is a perspective view of a laundry treating apparatus in accordance with one embodiment of the present invention.
Figure 2:
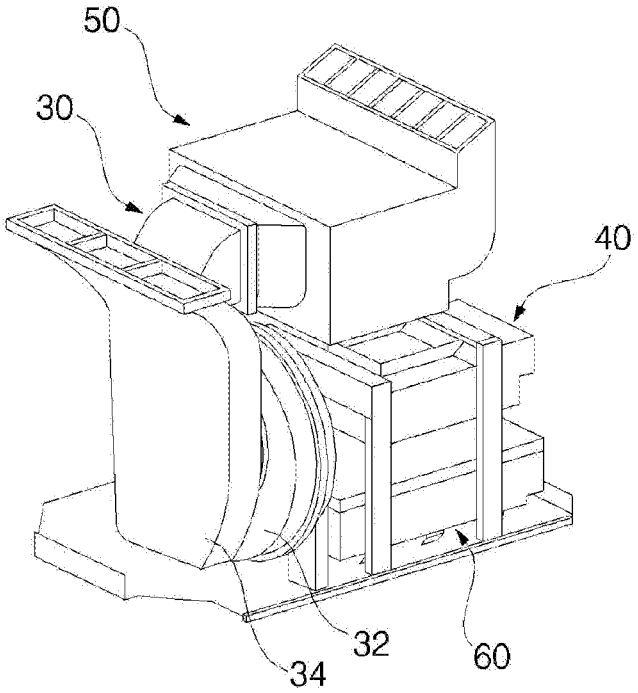
FIG. 2 is a perspective view illustrating some elements of the laundry treating apparatus shown in FIG. 1.
Figure 3:
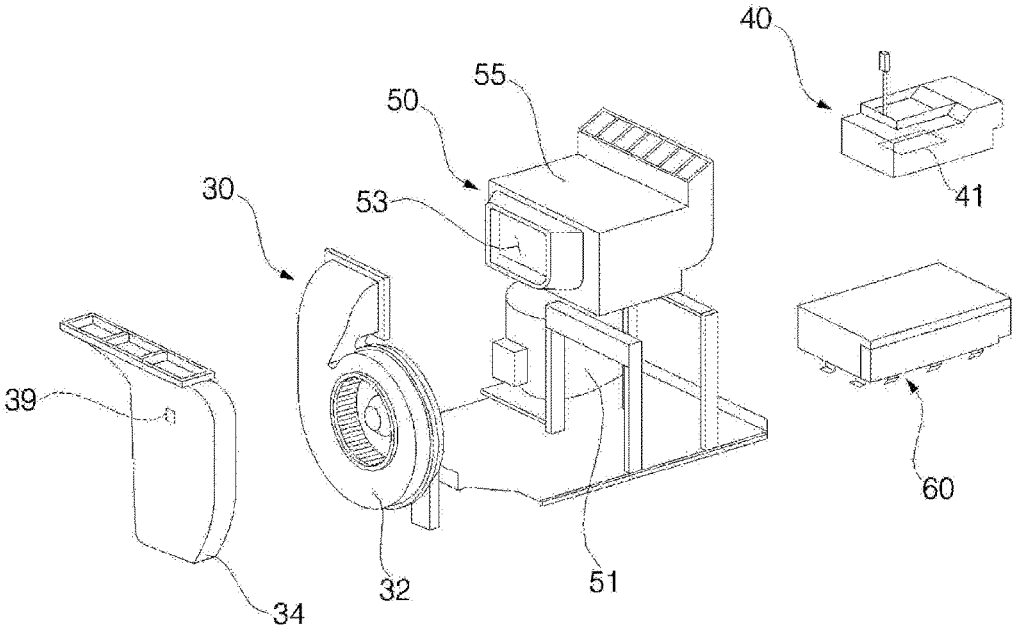
FIG. 3 is an exploded perspective view illustrating some elements of the laundry treating apparatus shown in FIG. 1.
Figure 4:
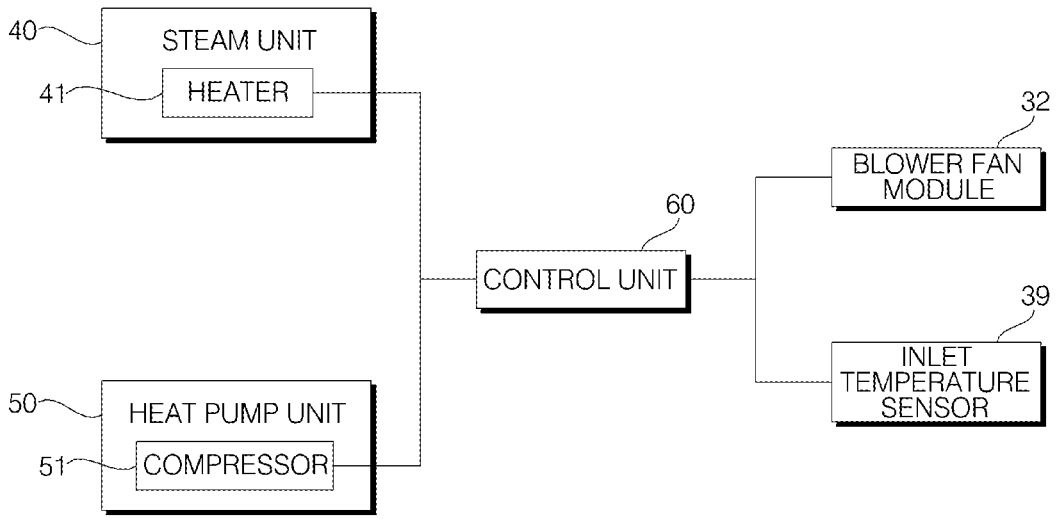
FIG. 4 is a block diagram of the laundry treating apparatus shown in FIG. 1.

FIG. 1 is a perspective view of a laundry treating apparatus in accordance with one embodiment of the present invention, FIG. 2 is a perspective view illustrating some elements of the laundry treating apparatus shown in FIG. 1, FIG. 3 is an exploded perspective view illustrating some elements of the laundry treating apparatus shown in FIG. 1, and FIG. 4 is a block diagram of the laundry treating apparatus shown in FIG. 1.

A plurality of laundry treating apparatuses in accordance with one embodiment of the present invention may be prepared. The respective laundry treating apparatuses may be independently operated. Each laundry treating apparatus includes a case 10, a door 20, a steam unit 40, a blower unit 30, a heat pump unit 50, a moving hanger 100 and a control unit 60.

The case 10 is provided with the door 20, and opening directions of the doors 20 of the cases 10 of the respective laundry treating apparatuses are different. That is, the door 20 of the case 10 of the laundry treating apparatus disposed at the left side is opened in a leftward direction, and the door 20 of the case 10 of the laundry treating apparatus disposed at the right side is opened in a rightward direction.

Here, the laundry treating apparatus disposed at the left side is referred to as a first laundry treating apparatus, and the laundry treating apparatus disposed at the right side is referred to as a second laundry treating apparatus.

The first laundry treating apparatus and the second laundry treating apparatus may be independently operated. For example, the control unit 60 of the first laundry treating apparatus and the control unit 60 of the second laundry treating apparatus may independently execute courses.

Particularly, the first laundry treating apparatus may be provided with a course to treat general clothing, and the second laundry treating apparatus may be provided with a course to treat specific clothing.

For example, the first laundry treating apparatus may be provided with a course to treat ordinary clothing, such as woolen clothing, knits, suits, coats, etc., and the second laundry treating apparatus may be provided with a course to treat functional clothing, such as uniforms, school uniforms, jeans, padding jumpers, etc.

Since the configurations of the first laundry treating apparatus and the second laundry treating apparatus in accordance with this embodiment are equal, the first and second laundry treating apparatuses will be referred to as laundry treating apparatuses without distinction.

The laundry treating apparatus in accordance with one embodiment of the present invention includes a case 10 provided with a treating chamber 12 and a cycle chamber 14, the door 20 assembled with the case 10 to open and close the treating chamber 12, the steam unit 40 which supplies steam to the treating chamber 12, the blower unit 30 which circulates air in the treating chamber 12, the heat pump unit 50 which conditions air in the treating chamber 12, the moving hanger 100 which is disposed in the treating chamber 12 such that clothing is hung on the moving hanger 100 and provides vibration to the clothing hung on the moving hanger 100, and the control unit 60 which controls the steam unit 40, the blower unit 30, the heat pump unit 50 or the moving hanger 100.

The case 10 is provided with a vertical separation plate to divide the inside of the case 10 in the vertical direction. The treating chamber 12 is provided above the vertical separation plate 11, and the cycle chamber 14 is provided below the vertical separation plate 11. An anterior-posterior separation plate 13 to divide the lower region of the treating chamber 12 is provided, and the anterior-posterior separation plate 13 forms the cycle chamber 14.

In this embodiment, the cycle chamber 14 is formed between the case 10 and the anterior-posterior separation plate 13. The vertical separation plate 11 and the anterior-posterior separation plate 13 are coupled.

A water supply tank 80 and a drain tank 90 are disposed in front of the anterior-posterior separation plate 13. The cycle chamber 14 is disposed at the rear of the anterior-posterior separation plate 13.

A tank installation space 16 in which the water supply tank 80 and the drain tank 90 are detachably installed is formed in front of the anterior-posterior separation plate 13.

In this embodiment, the door 20 simultaneously opens and closes the treating chamber 12 and the tank installation space 16. Differently from this embodiment, the door 20 may open and close only the treating chamber 12.

Clothing is hung in the treating chamber 12, and wrinkles or odors are removed from the clothing through steam, air circulation, drying, etc.

The blower unit 30 which draws in and then circulates air in the treating chamber 12, the steam unit 40 which supplies steam to the treating chamber 12, the heat pump unit 50 which supplies heated air to the treating chamber 12, and the control unit 60 which controls the respective units 30, 40 and 50 are installed in the cycle chamber 14.

The blower unit 30 draws in air in the treating chamber 12 under the control of the control unit 60. Air drawn into the blower unit 30 is discharged to the heat pump unit 50.

The blower unit 30 includes a blower fan module 32 which draws in air from the treating chamber 12 through rotation of a fan and then discharges the air, and an inlet duct 34 which is installed at an inlet of the blower fan module 32 and guides air in the treating chamber 12 to the blower fan module 32.

One side of the inlet duct 34 is connected to the treating chamber 12, and the other side of the inlet duct 34 is connected to the blower fan module 32. An inlet temperature sensor 39 which measures an inlet temperature, i.e., a temperature value of air circulating in the inlet duct 34, is installed in the inlet duct 34. The inlet temperature sensor 39 measures the inlet temperature corresponding to a temperature value of air drawn into the inlet duct 34 from the treating chamber 12 and transmits the measured inlet temperature to the control unit 60.

One side of the blower fan module 32 is connected to the inlet duct 34, and the other side of the blower fan module 32 is connected to the heat pump unit 50. The blower fan module 32 is one module including a sirocco fan, a duct and a motor.

The steam unit 40 supplies steam to the treating chamber 12 under the control of the control unit 60. The steam unit 40 is heated by applied power, heats water supplied from the water supply tank 80 and then generates steam.

Steam generated by the steam unit 40 is discharged to the treating chamber 12. In this embodiment, steam generated by the steam unit 40 flows into the treating chamber 12 through a flow path of the heat pump unit 50. The steam unit 40 may be connected to the heat pump unit 50.

Differently from this embodiment, a flow path of the steam unit 40 and a flow path of the heat pump unit 50 may be separately formed.

The steam unit 40 includes a heater 41 which heats water. Under the control of the control unit 60, the steam unit 40 executes preheating, i.e., initial heating of the heater 41, and then generates steam.

Under the control of the control unit 60, the heat pump unit 50 heats air drawn in by the blower unit 30 and discharges the heated air to the treating chamber 12. The heat pump unit 50 supplies the heated air to the treating chamber 12.

The heat pump unit 50 has a refrigeration cycle including a compressor 51, a condenser 53, an evaporator (not shown), and an expansion valve (not shown). The heat pump unit 50 includes a heat pump housing 55, and the condenser 53 is disposed in the heat pump housing 55. The heat pump housing 55 includes a heat pump flow path which guides air to the treating chamber 12.

The heat pump flow path is formed within the heat pump housing 55.

One side of the heat pump housing 55 is connected to the blower fan module 32, and the other side of the heat pump housing 55 is connected to the treating chamber 12.

The compressor 51 compresses a refrigerant to a high-temperature and high-pressure state. The refrigerant compressed by the compressor 51 exchanges heat with air in the condenser 53. The refrigerant passing through the condenser 53 is condensed by the condenser 53, expanded by the expansion valve, and then evaporated by the evaporator.

The refrigerant passing through the condenser 53 exchanges heat with air drawn in by the blower unit 30, and condensation heat generated during the condensation process of the refrigerant is discharged to air. Therefore, air drawn into the blower unit 30 is heated while passing through the condenser 53.

The anterior-posterior separation plate 13 is disposed in front of the cycle chamber 14, and the tank installation space 16 is formed by the anterior-posterior separation plate 13.

A tank module 70 is installed in the tank installation space 16. In this embodiment, the anterior-posterior separation plate 13 is disposed in front of the inlet duct 34 and, thus, the tank installation space 16 is formed.

The tank module 70 includes the water supply tank 80 which supplies water to the steam unit 40, and a drain tank 90 which collects and stores condensation water generated by at least one of the heat pump unit 50 and the treating chamber 12.

The water supply tank 80 is connected to the steam unit 40 and thus supplies water to the steam unit 40, and the drain tank 90 stores water condensed by the treating chamber 12 or the heat pump unit 50.

The control unit 60 receives an inlet temperature transmitted from the inlet temperature sensor 39. The control unit 60 controls the steam unit 40, the blower unit 30 and the heat pump unit 50 according to user settings or an inlet temperature and thus performs respective operations of the laundry treating apparatus to treat laundry according to a set course.

The control unit 60 may operate the blower unit 30 during a process of preheating the steam unit 40. The control unit 60 may control operation of the heat pump unit 50 based on a preheating inlet temperature measured by the inlet temperature sensor 39.

The control unit 60 may differently control the heat pump unit 50 according to the preheating inlet temperature.

If the preheating inlet temperature is higher than or equal to a predetermined reference inlet temperature, the control unit 60 may control the heat pump unit 50 so as to be slowly heated, as compared to if the preheating inlet temperature is lower than the reference inlet temperature.

That is, the control unit 60 may operate the compressor 51 at a predetermined first operating speed if the preheating inlet temperature is lower than the reference inlet temperature, and operate the compressor 51 at a predetermined second operating speed lower than the first operating speed if the preheating inlet temperature is higher than or equal to the reference inlet temperature.

The control unit 60 may control the heat pump unit 50 by comparing a drying inlet temperature measured by the inlet temperature sensor 39 to the preheating inlet temperature. That is, the control unit 60 stops operation of the heat pump unit 50 according to a difference between the drying inlet temperature and the preheating inlet temperature. The drying inlet temperature means a temperature measured by the inlet temperature sensor 39 during drying. The preheating inlet temperature means a temperature measured by the inlet temperature sensor 39 during preheating.

Figure 5:
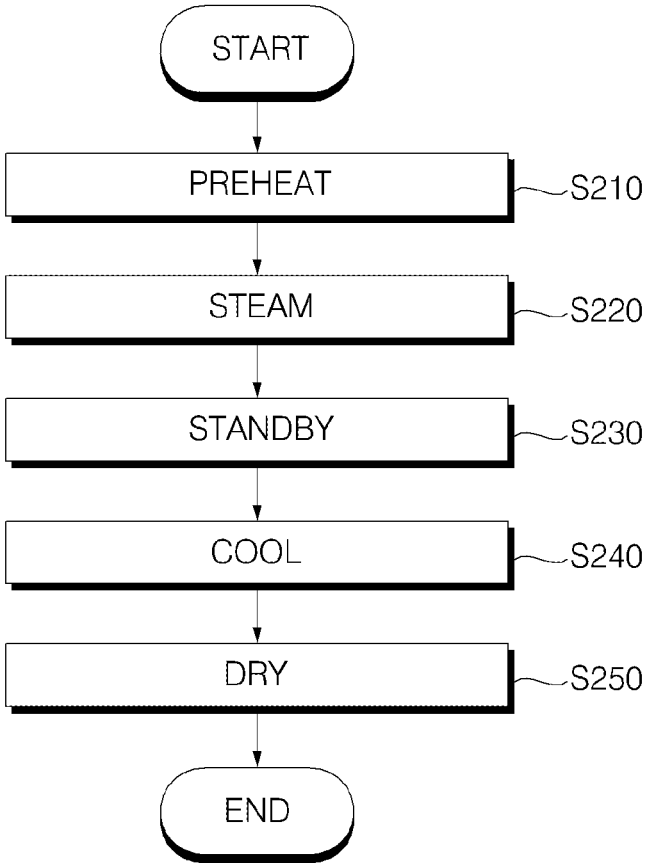
FIG. 5 is a flowchart illustrating respective operations of the laundry treating apparatus in accordance with one embodiment of the present invention.
Figure 6:
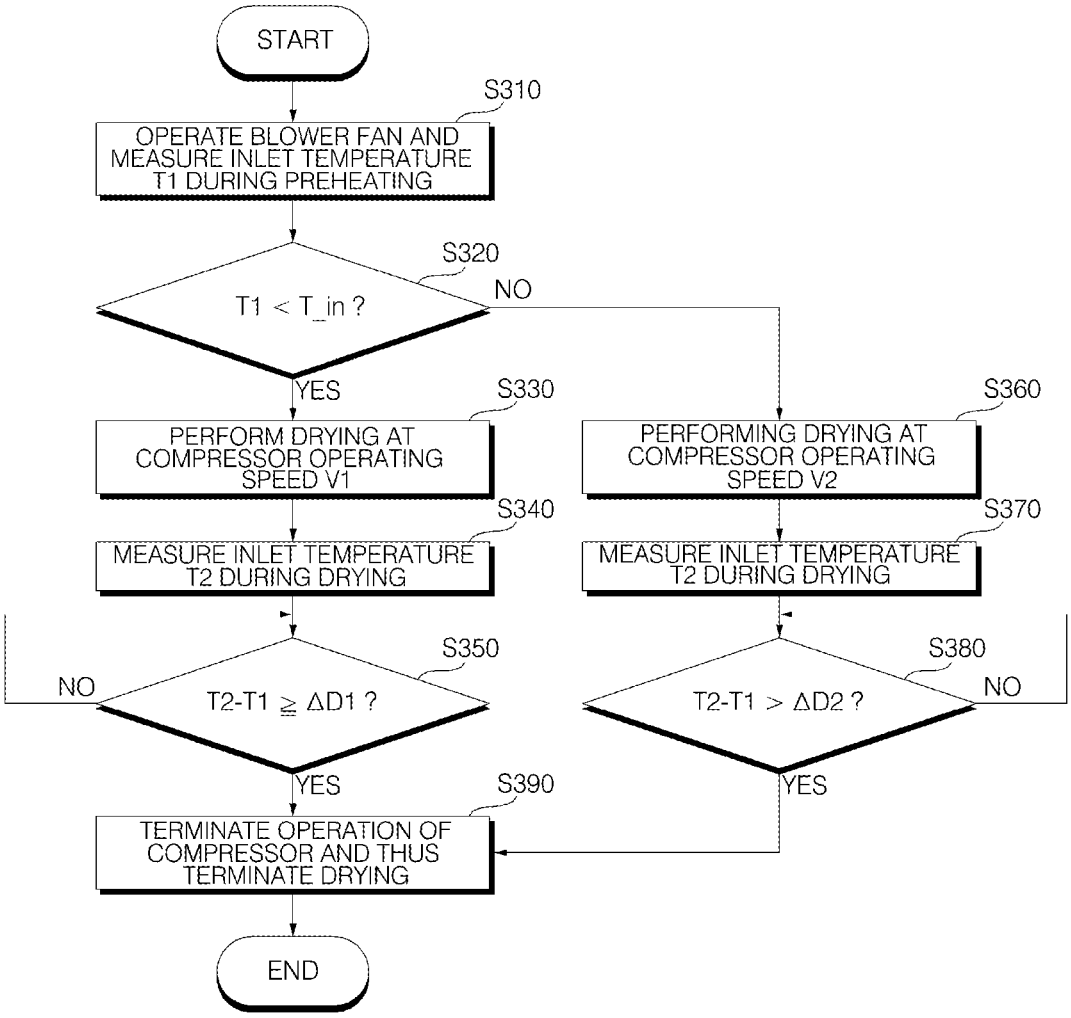
FIG. 6 is a flowchart illustrating a method of controlling the laundry treating apparatus in accordance with one embodiment of the present invention.

FIG. 5 is a flowchart illustrating respective operations of the laundry treating apparatus in accordance with one embodiment of the present invention, and FIG. 6 is a flowchart illustrating a method of controlling the laundry treating apparatus in accordance with one embodiment of the present invention.

When a user starts operation of the laundry treating apparatus, the control unit 60 performs a preheating operation S210 in which power is supplied to the heater 41 of the steam unit 41 so as to preheat the heater 41.

During the preheating operation S210, the control unit 60 operates the blower fan module 32 of the blower unit 30. When the blower fan module 32 is operated, the inlet temperature sensor 39 measures a temperature of air drawn into the inlet duct 34 of the blower unit 30 and transmits the measured preheating inlet temperature to the control unit 60.

When preheating of the heater 41 has been completed, the control unit 60 performs a steam operation S220.

Prior to performance of the steam operation S220, the control unit 60 may move water from the water supply tank 80 to the steam unit 40. Steam generated by the steam unit 40 is supplied to the treating chamber 12.

When the steam operation S220 is performed, the control unit 60 operates the blower fan module 32 to circulate air in the treating chamber 12. During the steam operation S220, the heat pump unit 50 is not operated.

When a predetermined time has elapsed, the control unit 60 stops operation of the steam unit 40 and thus terminates the steam operation S220.

After the steam operation S220, the control unit 60 performs a standby operation S230 and a cooling operation S240.

During the standby operation S230, the control unit 60 operates the blower fan module 32 at a relatively low rpm after operation of the steam unit 40 has been stopped. The standby operation S230 serves to supply a sufficient amount of steam to clothing. After the steam operation S220 has been terminated, a sufficient amount of steam is present in the treating chamber 12 and, during the standby operation S230, the sufficient amount of steam may be supplied to the clothing by circulating air.

During the cooling operation S240, the control unit 60 rotates the blower fan module 32 at a relatively high rpm and thus lowers the temperature of the inside of the treating chamber 12.

When a predetermined time has elapsed, the control unit 60 terminates the cooling operation S240.

After the cooling operation S240 has been terminated, the control unit 60 performs a drying operation S250. During the drying operation S250, the control unit 60 operates the blower fan module 32 and the heat pump unit 50 to heat the inside of the treating chamber 12.

The control unit 60 operates the blower fan module 32 and the compressor 51 and circulates air heated by the heat pump unit 50 to the treating chamber 12.

Operating conditions of the compressor 51 in the drying operation S250 and terminating conditions of the drying operation S250 will be described later with reference to FIG. 6.

Differential control according to a preheating inlet temperature T1 serves to achieve optimum efficiency according to surrounding environments.

If the heat pump unit 50 to perform drying is controlled according to temperature conditions (the preheating inlet temperature T1) of a space in which the laundry treating apparatus is installed, drying may be effectively performed.

For example, differential drying may be performed according to the season, e.g., winter or summer. Further, differential drying may be performed according to temperature conditions, e.g., a desert climate or a temperate climate.

If, in a high temperature environment, the compressor 51 is operated under the same conditions as in a low temperature environment, the temperature of the treating chamber 12 is excessively rapidly raised and, thus, moisture in the treating chamber 12 may not be sufficiently dried.

If drying is performed simply depending on the temperature of the treating chamber 12, steam supplied during the steam operation S220 may not be sufficiently dried.

Further, if the heat pump unit 50 is controlled only using one temperature condition, the compressor 51 is repeatedly turned on/off during drying of the inside of the treating chamber 12, thus lowering consumption efficiency.

With reference to FIG. 6, during the preheating operation S210, the control unit 60 operates the blower fan module 32 and the inlet temperature sensor 39 measures a temperature of air drawn into the blower unit 30, i.e., a preheating inlet temperature T1 (Operation S310). When the blower fan module 32 is operated, the measured preheating inlet temperature T1 is similar to the indoor temperature of the space in which the laundry treating apparatus is installed and, thus, the control unit 60 controls the heat pump unit 50 during the drying operation S250 based on the preheating inlet temperature T1.

The control unit 60 judges whether or not the preheating inlet temperature T1 is lower than a predetermined reference inlet temperature T_in (Operation S320). The reference inlet temperature T_in is set to 45° C. so as to correspond to a high temperature environment.

If the preheating inlet temperature T1 is lower than the predetermined reference inlet temperature T_in, the control unit 60 operates the compressor 51 at a predetermined first operating speed V1 and thus performs the drying operation S250 (Operation S330). The first operating speed V1 is set to be relatively high so that the heat pump unit 50 relatively rapidly heats air drawn in by the blower unit 30 so as to correspond to drying in a room temperature environment.

While the compressor 51 is operated at the first operating speed V1, the inlet temperature sensor 39 continues to measure a temperature value of air drawn into the blower unit 30, i.e., a drying inlet temperature T2 (Operation S340). The inlet temperature sensor 39 transmits the measured drying inlet temperature T2 to the control unit 60.

The control unit 60 judges whether or not a difference between the preheating inlet temperature T1 and the drying inlet temperature T2 measured by the inlet temperature sensor 39 during the drying operation S250 is greater than or equal to a predetermined first reference temperature difference ΔD1 (Operation S350). The drying inlet temperature T2 is a temperature value continuously measured by the inlet temperature sensor 39 when the compressor 51 is operated, and the preheating inlet temperature T1 is a temperature value measured by the inlet temperature sensor 39 during the preheating operation S210. The first reference temperature difference ΔD1 corresponds to drying in a room temperature environment. The first reference temperature difference ΔD1 is set to a relatively great value so that air heated by the heat pump unit 50 may be supplied to the inside of the treating chamber 12 for a relatively long time.

If the difference between the preheating inlet temperature T1 and the drying inlet temperature T2 is less than the first reference temperature difference ΔD1, the control unit 60 continues to measure the drying inlet temperature T2 and judges whether or not a difference between the preheating inlet temperature T1 and the drying inlet temperature T2 is greater than or equal to the first reference temperature difference ΔD1.

If the difference between the preheating inlet temperature T1 and the drying inlet temperature T2 is greater than or equal to the first reference temperature difference ΔD1, the control unit 60 terminates operation of the compressor 51 and stops operation of the blower fan module 32, thus terminating the drying operation S250 (Operation S390).

If the preheating inlet temperature T1 is higher than or equal to the reference inlet temperature T_in, the control unit 60 operates the compressor 51 at a predetermined second operating speed V2 and thus performs the drying operation S250 (Operation S360).

The second operating speed V2 is set to be relatively low so that the heat pump unit 50 relatively slowly heats air drawn in by the blower unit 30 so as to correspond to drying in a high temperature environment. That is, the second operating speed V2 is set to be lower than the first operating speed V1.

The compressor 51 is operated at the second operating speed V2, and the inlet temperature sensor 39 continues to measure a temperature value of air drawn into the blower unit 30, i.e., the drying inlet temperature T2 (Operation S370). The inlet temperature sensor 39 transmits the measured drying inlet temperature T2 to the control unit 60.

The control unit 60 judges whether or not a difference between the preheating inlet temperature T1 and the drying inlet temperature T2 measured by the inlet temperature sensor is greater than or equal to a predetermined second reference temperature difference ΔD2 (Operation S380).

The drying inlet temperature T2 is a temperature value continuously measured by the inlet temperature sensor 39 when the compressor 51 is operated, and the preheating inlet temperature T1 is a temperature value measured by the inlet temperature sensor 39 during the preheating operation S210.

The second reference temperature difference ΔD2 corresponds to drying in a high temperature environment. The second reference temperature difference ΔD2 is set to a relatively small value so that air heated by the heat pump unit 50 may be supplied to the inside of the treating chamber 12 for a relatively short time.

If the difference between the preheating inlet temperature T1 and the drying inlet temperature T2 is less than the second reference temperature difference ΔD2, the control unit 60 continues to measure the drying inlet temperature T2 and judges whether or not a difference between the preheating inlet temperature T1 and the drying inlet temperature T2 is greater than or equal to the second reference temperature difference ΔD2.

If the difference between the preheating inlet temperature T1 and the drying inlet temperature T2 is greater than or equal to the second reference temperature difference ΔD2, the control unit 60 terminates operation of the compressor 51 and stops operation of the blower fan module 32, thus terminating the drying operation S250 (Operation S390).

As in this embodiment, if the compressor 31 is operated at the relatively low second operating speed V2 in a high temperature environment, rise in the temperature of the treating chamber 12 may be gently achieved.

If the temperature of the treating chamber 12 is gently raised in the high temperature environment, turning-on/off of the compressor 51 may be minimized and a time taken to dry moisture may be secured.

Figure 7:
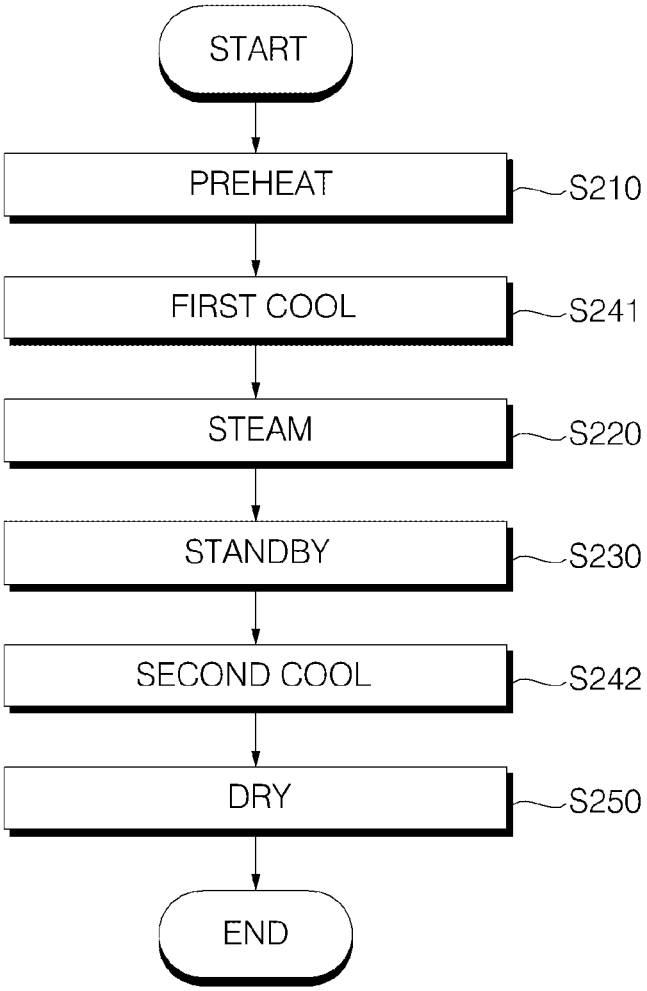
FIG. 7 is a flowchart illustrating respective operations in a uniform course in accordance with one embodiment of the present invention.

FIG. 7 is a flowchart illustrating respective operations in a uniform course in accordance with one embodiment of the present invention.

Differently from FIG. 5, in the uniform course shown in FIG. 7, a first cooling operation S241 is further performed between a preheating operation S210 and a steam operation S220.

Further, differently from FIG. 5, in the uniform course shown in FIG. 7, a second cooling operation S242 is further performed and thus two cooling operations S241 and S242 are performed.

The uniform course is executed for clothing which is frequently worn, such as a uniform.

Such a uniform course or a school uniform course is operated when a user selects this course. In this embodiment, the uniform course is defined as a first course. In addition to the uniform course, various other courses including a second course to treat general clothing may be provided.

An object of the uniform course is to remove dust, odors and winkles from clothing which is frequently worn. The uniform course is a course to minimize washing of clothing which is frequently worn.

When a user starts operation of the laundry treating apparatus, the control unit 60 supplies power to the heater 41 of the steam unit 40 and thus performs the preheating operation S210 to preheat the heater 41.

The preheating operation S210 is performed for a preheating time. For example, the preheating time may be 2 minutes.

During the preheating operation S210, the control unit 60 operates the blower fan module 32 of the blower unit 30. When the blower fan module 32 is operated, the inlet temperature sensor 39 measures a temperature of air drawn into the inlet duct 34 of the blower unit 30 and transmits the measured preheating inlet temperature to the control unit 60.

When preheating of the heater 41 has been completed, the control unit 60 performs the cooling operation S241.

The cooling operation S241 is defined as a first cooling operation, and the cooling operation S242 after the standby operation S230 is defined as a second cooling operation.

The first cooling operation S241 is performed for a first cooling time. For example, the first cooling time may be 5 minutes.

During the first cooling operation S241, the moving hanger 100 and the blower fan module 32 are operated.

When the moving hanger 100 is operated, the blower fan module 32 is operated to separate foreign substances and odors from uniforms.

In order to rapidly remove odors and foreign substances from the uniforms, the blower fan module 32 may be operated at a maximum intensity.

In this embodiment, the operating rpm of the blower fan module 32 in the first cooling operation S241 is defined as a first cooling rpm. For example, the first cooling rpm may be 1800 rpm. (제 1 냉각 rpm 과 제 2 냉각 rpm 이 동일하다고 기재되어 있으므로 1080 rpm 을 1800 rpm 으로 통일하 였으니 수치 확인 바랍니다 .)

In the first cooling operation S241, the control unit 60 operates the moving hanger 100 and the blower fan module 32 for a first cooling time, and operates the blower fan module 32 at the first cooling rpm.

The preheating operation S210 may be performed simultaneously with the first cooling operation S241. That is, the preheating operation S210 may be performed within the first cooling time.

The reason for this is that a time of the preheating operation S210 is shorter than the first cooling time.

If the preheating operation S210 and the first cooling operation S241 are simultaneously performed, an operating time may be shortened.

After the first cooling operation S241 has been terminated, the steam operation S220 is performed.

The control unit 60 may move water from the water supply tank 80 to the steam unit 40 prior to performance of the steam operation S220. Steam generated by the steam unit 40 is supplied to the treating chamber 12.

The control unit 60 may move water stored in the water supply tank 80 to the steam unit 40 during any of the preheating operation S210 and the first cooling operation S241.

The control unit 60 performs the steam operation S220 for a first steam time. During the steam operation S220, the moving hanger 100 is stopped and the blower fan module 32 is operated. During the steam operation S220, the heat pump unit 50 is not operated.

During the steam operation S220, the blower fan module 32 is operated at a steam rpm. For example, the steam rpm may be 1050 rpm. The steam rpm is lower than the first cooling rpm. During the steam operation S220, steam is supplied to the inside of the treating chamber 12 by operation of the blower fan module 32.

When the set first steam time has elapsed, the control unit 60 stops operation of the steam unit 40 and thus terminates the steam operation S220.

After the steam operation S220, the control unit 60 performs the standby operation S230 and the second cooling operation S242.

In the standby operation S230, operation of the steam unit 40 is stopped and then the blower fan module 32 is rotated at a relatively low rpm. In the standby operation S230, the blower fan module 32 is operated at a standby rpm. For example, the standby rpm may be 1050 rpm.

The standby operation S230 serves to supply a sufficient amount of steam to clothing. After the steam operation S220 has been terminated, a sufficient amount of steam is present in the treating chamber 12 and, during the standby operation S230, the sufficient amount of steam may be supplied to the clothing by circulating air.

The standby operation 230 is performed for a standby time. For example, the standby time may be 5 minutes. During the standby operation S230, the moving hanger 100 may be operated.

In the standby operation S230, the moving hanger 100 is operated so that steam may actively contact uniforms.

In the second cooling operation S242, the blower fan module 32 is rotated at a relatively high rpm, thus lowering the temperature of the inside of the treating chamber 12. In the second cooling operation S242, the blower fan module 32 is operated at a second cooling rpm. For example, the second cooling rpm may be 1800 rpm. In this embodiment, the first cooling rpm and the second cooling rpm are set to be equal. Differently from this embodiment, the second cooling rpm may be set to be lower than the first cooling rpm.

The second cooling operation S242 is performed for a second cooling time. For example, the second cooling time may be 3 minutes. The second cooling time is set to be shorter than the first cooling time.

Since foreign substances and odors are removed from the uniforms during the first cooling operation S241, the second cooling time of the second cooling operation S242 may be short.

In the second cooling operation S242, the control unit 60 operates the moving hanger 100. By operating the moving hanger 100, the temperature of the uniforms to which steam is supplied may be more actively lowered.

When the second cooling time has elapsed, the control unit 60 terminates the second cooling operation S242.

After the second cooling operation S242 has been terminated, the control unit 60 performs the drying operation S250. In the drying operation S250, the moving hanger 100, the blower fan module 32 and the heat pump unit 50 are operated. The drying operation S250 is performed for a drying time. For example, the drying time may be 44 minutes.

The control unit 60 controls the blower fan module 32 so as to have a rotational speed of 1200 rpm to 1800 rpm. The rotational speed of the blower fan module 32 is controlled according to the temperature of the treating chamber 12.

The control unit 60 operates the blower fan module 32 and the compressor 51 and, thus, circulates air heated by the heat pump unit 50 to the treating chamber 12 and dries the inside of the treating chamber 12. While the drying operation S250 is performed, the control unit 60 operates the moving hanger 100 and thus actively performs drying of the uniforms.

During the drying operation S250, differential drying is performed according to surrounding temperatures, as described above with reference to FIG. 6.

Figure 8:
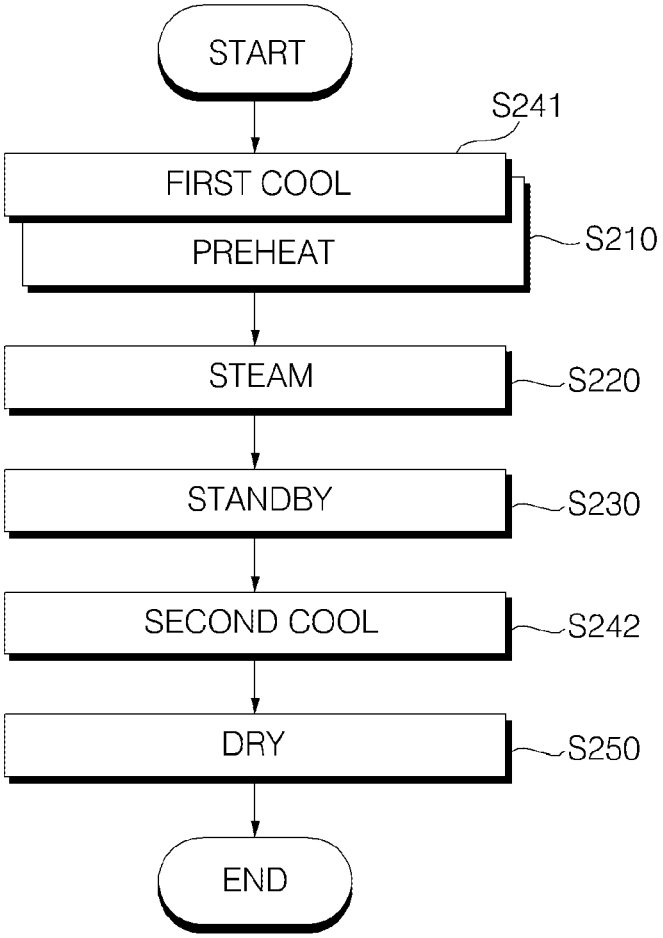
FIG. 8 is a flowchart illustrating respective operations in a uniform course in accordance with another embodiment of the present invention.

FIG. 8 is a flowchart illustrating respective operations in a uniform course in accordance with another embodiment of the present invention.

Differently from the uniform course shown in FIG. 7, in the uniform course in accordance with this embodiment, the preheating operation S210 is performed during the first cooling operation S241 or after the first cooling operation S241.

If the preheating operation S210 is performed during the first cooling operation S241, a total required time may be shortened.

Particularly, if the end time of the first cooling operation S241 and the end time of the preheating operation S210 coincide with each other, the steam operation S220 may be immediately performed. In this case, heat loss of the preheated steam unit 40 may be minimized.

The remaining operations of the uniform course in accordance with this embodiment are the same as those of the uniform course in accordance with the earlier embodiment shown in FIG. 7 and a detailed description thereof will thus be omitted.

As apparent from the above description, a method of controlling a laundry treating apparatus in accordance with one embodiment of the present invention has at least one of effects described below.

First, a uniform course, in which foreign substances, odors and wrinkles may be removed from uniforms having high frequency of wearing, is executed.

Second, if uniforms having high frequency of wearing are treated, a first cooling operation is performed before steam is supplied, thus more actively removing foreign substances and odors from the uniforms.

Third, since the first cooling operation is performed before steam is supplied, fixation of foreign substances or odor causing compounds of uniforms to the uniforms together with steam is suppressed.

Fourth, since a moving hanger is operated and air is circulated before steam is supplied, fixation of foreign substances or odor causing compounds of uniforms to the uniforms together with steam is suppressed and, thus, the foreign substances or odor causing compounds are actively removed from the uniforms.

Fifth, since the first cooling operation and a preheating operation are simultaneously performed before steam is supplied, increase in a total required time may be minimized.

Sixth, by coinciding the end time of the first cooling operation and the end time of the preheating time with each other, a total required time may be minimized and heat loss of a steam unit may be minimized.

Seventh, a heat pump unit to perform drying is controlled according to temperature conditions of a space in which the laundry treating apparatus is installed, thereby effectively performing drying.

Eighth, the operating speed of a compressor of the heat pump unit is controlled according to temperature conditions of the space in which the laundry treating apparatus is installed, thereby effectively performing drying.

Ninth, whether or not operation of the heat pump unit is stopped is judged according to temperature conditions of the space in which the laundry treating apparatus is installed and temperatures of the inside of a treating chamber in which clothing is hung when the heat pump unit is operated, thereby effectively performing drying.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A method of controlling a laundry treating apparatus, the laundry treating apparatus comprising a case, a treating chamber located inside the case and configured to receive clothes, a hanger disposed in the treating chamber to hang the clothes thereon, a cycle chamber located below the treating chamber inside the case and configured to accommodate a steam unit for generating and supplying steam and a blower unit, the method comprising:

performing a first cooling operation for circulating air in the treating chamber by operating the blower unit with a first cooling rpm in the treating chamber;

supplying steam into the treating chamber by operation of the steam unit after the first cooling operation; and performing a second cooling operation for circulating air in the treating chamber by operating the blower unit with a second cooling rpm in the treating chamber after supplying steam, wherein the second cooling rpm is equal to or higher than the first cooling rpm.

2. The method of claim 1, wherein a first cooling time for performing the first cooling operation is longer than the second cooling time for performing the second cooling operation.

3. The method of claim 1, wherein the blower unit operates with a steam rpm, while supplying steam.

4. The method of claim 1, wherein the first cooling rpm is higher than the steam rpm.

5. The method of claim 1, further comprising:

supplying hot air into the treating chamber for drying clothes by operating a heat pump unit inside the cycle chamber after the second cooling operation.

6. The method of claim 5, wherein, during supplying the hot air into the treating chamber, a blower unit operates with a dryness rpm for circulating air in the treating chamber.

7. The method of claim 5, wherein the heat pump unit includes a compressor to compress a refrigerant and a condenser to exchange heat between the refrigerant compressed by the compressor and the air circulated by the blower unit, and wherein, during supplying the hot air into the treating chamber, the compressor operates with a different operating speed based on a preheating inlet temperature measured by an inlet temperature sensor of the blower unit during the preheating operation.

8. The method of claim 7, wherein the compressor operates at a predetermined first operating speed if the preheating inlet temperature is lower than a predetermined reference inlet temperature, and wherein the compressor at a predetermined second operating speed if the preheating inlet temperature is higher than or equal to the predetermined reference inlet temperature.

9. The method of claim 8, wherein the second operating speed is less than the first operating speed.

10. The method of claim 1, further comprising:

performing a standby operation to operate the blower unit with a standby rpm between supplying steam and performing the second cooling operation.

11. The method of claim 10, wherein the first cooling rpm is higher than the steam rpm and the standby rpm.

12. The method of claim 10, wherein the steam rpm is equal to the standby rpm.

13. The method of claim 10, wherein a standby time for performing the standby operation is longer than a second cooling time for performing the second cooling operation.

14. The method of claim 1, further comprising:

performing a preheating operation by supplying power to the steam unit for preheating water in the steam unit using a heater of the steam unit.

15. The method of claim 14, wherein the preheating operation performs before the first cooling operation or during the first cooling operation.

16. The method of claim 14, wherein the first cooling operation and the preheating operation end simultaneously.

17. The method of claim 14, wherein, during the preheating operation, a water supply tank located forward to the cycle chamber below the treating chamber supplies the water to the steam unit.

18. The method of claim 14, a preheating time for the preheating operation is shorter than a first cooling time for performing the first cooling operation.

19. The method of claim 18, the first cooling time is longer than a second cooling time for performing the second cooling operation.

20. The method of claim 19, the preheating time is shorter than the second cooling time.

* * * * *